US009749071B2

(12) United States Patent
Jung et al.

(10) Patent No.: US 9,749,071 B2
(45) Date of Patent: Aug. 29, 2017

(54) RADIO BROADCAST APPARATUS AND METHOD FOR SIMULTANEOUS PLAYBACK AND RADIO CHANNEL SCANNING

(71) Applicant: Samsung Electronics Co., Ltd., Gyeonggi-do (KR)

(72) Inventors: Hoonsoub Jung, Gyeongsangbuk-do (KR); Yonggil Han, Gyeongsangbuk-do (KR); Haksung Lyou, Gyeongsangbuk-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 14/589,388

(22) Filed: Jan. 5, 2015

(65) Prior Publication Data

US 2015/0195053 A1 Jul. 9, 2015

(30) Foreign Application Priority Data

Jan. 3, 2014 (KR) ..... 10-2014-0000908

(51) Int. Cl.
*H04H 40/27* (2008.01)
*H04H 60/41* (2008.01)
*H04H 60/90* (2008.01)

(52) U.S. Cl.
CPC ..... *H04H 40/27* (2013.01); *H04H 60/41* (2013.01); *H04H 60/90* (2013.01); *H04H 2201/37* (2013.01)

(58) Field of Classification Search
CPC ..... H04H 60/41; H04H 60/43; H04H 60/44
See application file for complete search history.

(56) References Cited

U.S. PATENT DOCUMENTS 6,571,392 B1 * 5/2003 Zigmond ..... H04H 20/93 348/E5.002
6,804,510 B1 * 10/2004 Bates ..... H04H 20/24 455/154.1
7,274,905 B1 * 9/2007 Nguyen ..... H04H 40/90 455/12.1
7,274,906 B1 * 9/2007 Nguyen ..... H04H 40/90 455/12.1
9,172,478 B2 * 10/2015 Kim ..... H04H 20/22
2001/0023395 A1 * 9/2001 Su ..... G10L 19/005 704/220
2002/0039892 A1 * 4/2002 Lindell ..... H04W 48/18 455/151.1
2002/0058475 A1 * 5/2002 Patsiokas ..... H04B 1/207 455/3.02

(Continued)

FOREIGN PATENT DOCUMENTS

KR 10-2001-0057313 7/2001
KR 10-2009-0075144 7/2009
KR 10-2012-0007376 1/2012

*Primary Examiner* — Devan Sandiford
(74) *Attorney, Agent, or Firm* — The Farrell Law Firm, P.C.

(57) ABSTRACT

A radio broadcast playback method and apparatus is provided. The radio broadcast playback method includes playing a radio broadcast received by a tuner, receiving a channel search request, through an input unit, searching for radio channels by a communication module, while playing the radio broadcast received by the tuner, and outputting the found radio channels.

19 Claims, 7 Drawing Sheets

(56) References Cited

U.S. PATENT DOCUMENTS

2002/0067437 A1* 6/2002 Tsubouchi ..... H04H 60/43 348/725
2004/0004631 A1* 1/2004 Debique ..... H04L 29/06 715/704
2004/0010542 A1* 1/2004 Kumar ..... H04L 41/0893 709/203
2004/0176061 A1* 9/2004 Zehnle ..... H04H 60/29 455/191.1
2005/0020223 A1* 1/2005 Ellis ..... H04B 1/20 455/186.1
2005/0289591 A1* 12/2005 Vermola ..... H04N 5/44543 725/45
2006/0133775 A1* 6/2006 Ju ..... H04N 5/76 386/295
2006/0153541 A1* 7/2006 Dumont ..... H04N 9/7921 386/326
2006/0181652 A1* 8/2006 Hagiwara ..... H03J 1/0075 348/732
2007/0039028 A1* 2/2007 Bar ..... H04N 21/23439 725/95
2007/0233816 A1* 10/2007 Odenwald ..... G06F 17/30743 709/219
2008/0139109 A1* 6/2008 Ewertz ..... H04H 20/12 455/3.01
2008/0226119 A1* 9/2008 Candelore ..... G06F 17/30256 382/100
2008/0313671 A1* 12/2008 Batrouny ..... H04H 60/43 725/40
2009/0055195 A1* 2/2009 Karlsgodt ..... H04H 20/82 704/500
2009/0247099 A1* 10/2009 Jaisimha ..... H03J 1/0066 455/161.2
2009/0319568 A1* 12/2009 Klemets ..... G06F 17/30038
2011/0179451 A1* 7/2011 Miles ..... H04N 5/445 725/42
2011/0306313 A1* 12/2011 Jaisimha ..... H04H 20/22 455/185.1
2012/0190319 A1* 7/2012 Thomas ..... H04B 1/082 455/179.1
2014/0213175 A1* 7/2014 Jaisimha ..... H04H 20/22 455/3.06
2014/0365759 A1* 12/2014 Wang ..... H04L 67/02 713/151

* cited by examiner

RADIO BROADCAST APPARATUS AND METHOD FOR SIMULTANEOUS PLAYBACK AND RADIO CHANNEL SCANNING

PRIORITY

This application claims priority under 35 U.S.C. §119(a) to Korean Patent Application, filed on Jan. 3, 2014, in the Korean Intellectual Property Office and assigned Serial Number 10-2014-0000908, the entire disclosure of which is incorporated herein by reference.

BACKGROUND

1. Field of the Invention

The present invention relates generally to a radio broadcast playback method.

2. Description of Related Art

Radio Broadcasting is used to transmit audio content over radio waves. Radio broadcasting is a type of analog broadcast based on Frequency Modulation (FM). With the advance of communication technology, research has been recently focused on Hybrid Radio, which is capable of broadcasting both analog and digital audio signals.

In the conventional art, if a request is received by the radio broadcast device to switch the current channel to another channel or to scan channels in the middle of playing the radio broadcast, the current playback is cut off. This is because the FM module cannot process two commands simultaneously. That is, the FM module cannot execute the radio broadcast playback command and the channel scan command simultaneously and, thus, the radio broadcast playback is cut off.

SUMMARY

The present invention has been made to address at least the problems and the disadvantages described above, and to provide at least the advantages described below.

Accordingly, an aspect of the present invention is to provide a radio broadcast playback method and apparatus that is capable of allowing scanning radio broadcast channels while playing a certain radio broadcast channel.

In accordance with an aspect of the present invention, a radio broadcast playback method is provided. The radio broadcast playback method includes playing a radio broadcast received by a tuner, receiving a channel search request, through an input unit, searching for radio channels, by a communication module while playing the radio broadcast received by the tuner, and outputting the found radio channels.

In accordance with another aspect of the present invention, a radio broadcast playback method is provided. The radio broadcast playback method includes playing a radio broadcast received by a tuner, receiving a channel scan request, through an input unit, switching a playback path of the radio broadcast from the tuner to a communication module, scanning radio channels by means of the tuner, and displaying, when scanning is completed, radio channels found by the tuner.

In accordance with another aspect of the present invention, a radio broadcast playback method is provided. The radio broadcast playback method includes recording a first radio broadcast, which is received by a tuner for playback, searching for a second radio broadcast by means of a communication module, while playing the first radio broadcast received by the tuner, and playing and recording the second radio broadcast found by the communication module.

In accordance with another aspect of the present invention, a method for switching a playback path of a radio broadcast is provided. The method includes playing the radio broadcast received by a tuner, receiving a request for digital radio playback, through an input unit, and switching the playback path from the tuner to a communication module.

In accordance with another aspect of the present invention, a radio broadcast playback apparatus is provided. The radio broadcast playback apparatus includes a tuner configured to receive a radio broadcast for playback, an input unit configured to receive a channel search request, a communication module configured to search for radio channels, while the radio broadcast received by the tuner is played, and a control unit configured to control, when searching is completed, the tuner to output found radio channels.

In accordance with another aspect of the present invention, a radio broadcast playback apparatus is provided. The radio broadcast playback apparatus includes a tuner configured to receive a radio broadcast for playback, an input unit configured to receive a channel scan request, and a control unit configured to switch a playback path of the radio broadcast from the tuner to a communication module and control the communication module to receive the radio broadcast for playback, wherein the tuner scans radio channels in response to the channel scan request, and the control unit control, when scanning is completed, the tuner to output found radio channels.

In accordance with still another aspect of the present invention, a radio broadcast playback apparatus is provided. The radio broadcast playback apparatus includes a tuner configured to play a first radio broadcast, a recording unit configured to record the first radio broadcast, an input unit configured to receive a request for recording a second radio broadcast different from the first radio broadcast, and a communication module configured to search for the second radio broadcast and receive the second radio broadcast for playback, while the first radio broadcast received by the tuner is played, wherein the recording unit records the second radio broadcast which is being played.

BRIEF DESCRIPTION OF THE DRAWINGS

The above and other aspects, features, and advantages of the present invention will be more apparent from the following detailed description taken in conjunction with the accompanying drawings in which.

DETAILED DESCRIPTION OF EMBODIMENTS OF THE PRESENT INVENTION

Embodiments of the present invention are described more fully with reference to the non-limiting embodiments that are illustrated in the accompanying drawings. The same reference numbers are used throughout the drawings to refer to the same or like parts. Detailed description of well-known functions and structures incorporated herein may be omitted to avoid obscuring the subject matter of the present invention. This aims to omit unnecessary description so as to make the subject matter of the present invention clear.

The radio broadcast playback apparatus of the present invention may be a part of an electronic device. The electronic device, according to an embodiment of the present invention, may have a communication function. Examples of the electronic device include a smartphone, a tablet Personal Computer (PC), a mobile phone, a video phone, an e-book reader, a desktop PC, a laptop PC, a netbook computer, a Personal Digital Assistant (PDA), a Portable Multimedia Player (PMP), a MP3 player, a mobile medical appliance, a camera, and a wearable device (e.g. electronic glasses, a head-mounted-device (HMD), electronic clothing, an electronic bracelet, an electronic necklace, an electronic appcessory, an electronic tattoo, and a smartwatch).

According to an embodiment of the present invention, the electronic device may be a smart home appliance having a communication function. Examples of the smart home appliance include a television, a Digital Video Disk (DVD) player, an audio system, a refrigerator, an air conditioner, a vacuum cleaner, an electric range, a microwave oven, a laundry machine, an air cleaner, a set-top box, a game console, an electronic dictionary, an electronic key, a camcorder, and an electronic frame.

According to an embodiment of the present invention, examples of the electronic device include a medical apparatus (such as Magnetic Resonance Angiography (MRA), Magnetic Resonance Imaging (MRI), Computed Tomography (CT), and Ultrasound imaging), a navigation device, a Global Positioning System (GPS) receiver, an Event Data Recorder (EDR), a Flight Data Recorder (FDR), a car infotainment system, electronic equipment for ships (such as maritime navigation device and gyro compass), an aviation electronic device (avionics), a security device, an industrial robot, and a home robot.

According to an embodiment of the present invention, examples of the electronic device include furniture or part of a building/structure which has a communication function, an electronic board, an electronic signature receiving device, a projector, and a metering device (such as water, power, gas, and electric wave measurement devices). The electronic device according to an embodiment of the present invention may be any or a combination of the above devices. It is obvious to those in the art that the electronic device is not limited to the above-enumerated devices.

Figure 1:
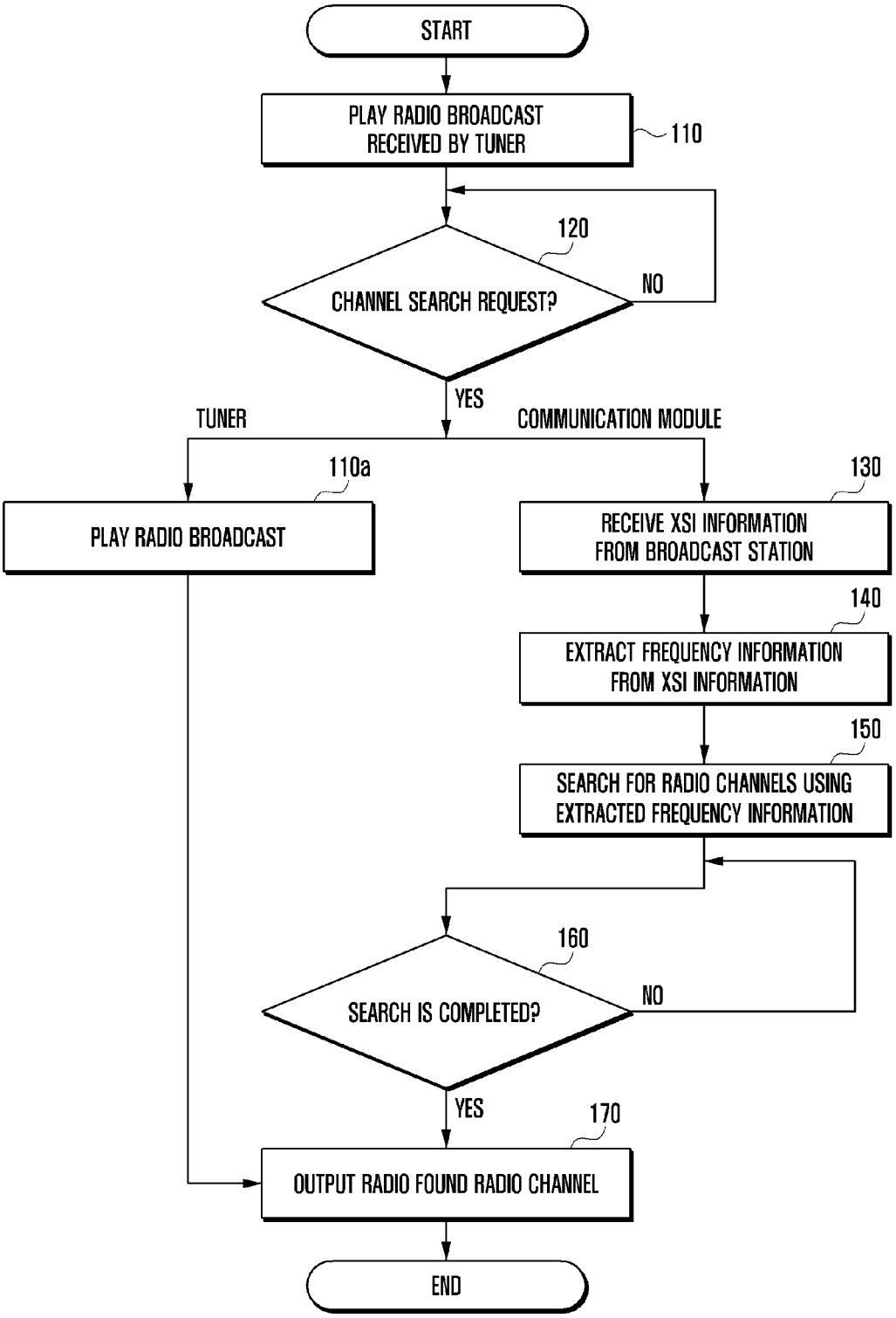
FIG. 1 is a flowchart illustrating a radio broadcast playback method, according to an embodiment of the present invention.

FIG. 1 is a flowchart illustrating a radio broadcast playback method ,according to an embodiment of the present invention.

Referring to FIG. 1, the radio broadcast playback method, according to an embodiment of the present invention, is executed by the radio broadcast playback apparatus 700.

Figure 7:
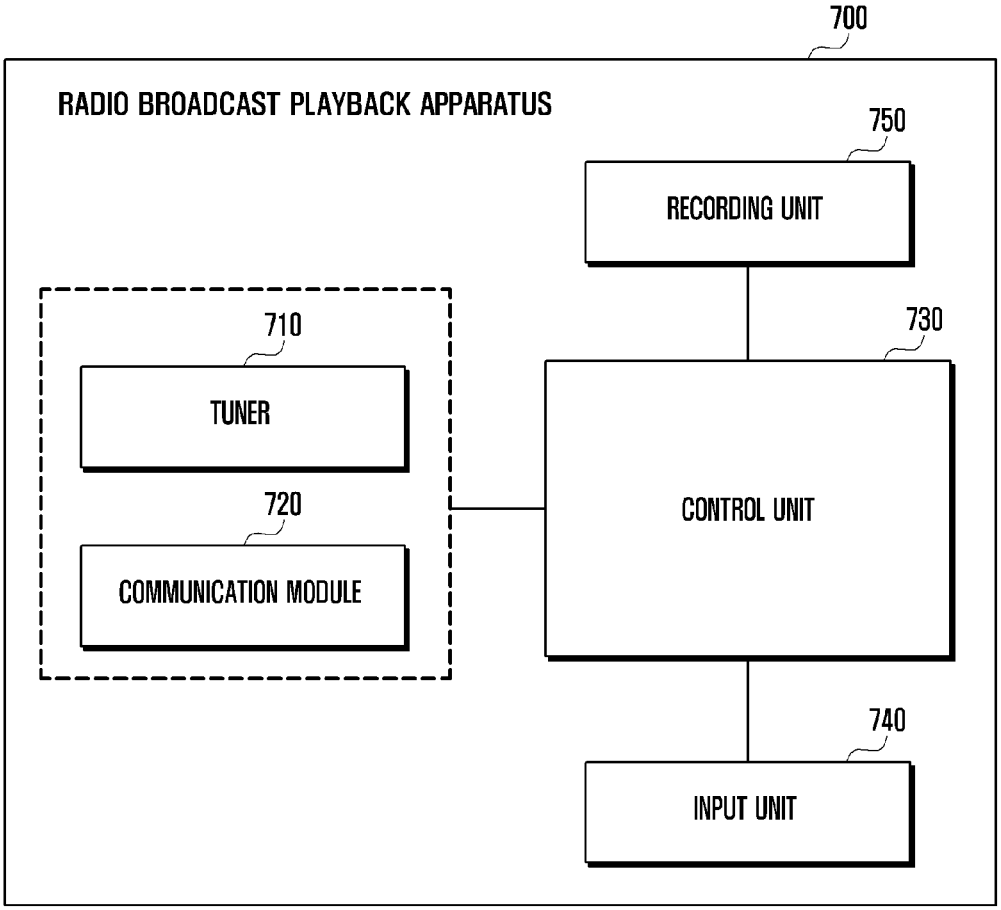
FIG. 7 is a block diagram illustrating a configuration of a radio broadcast playback apparatus, according to an embodiment of the present invention.

FIG. 7 is a block diagram illustrating a configuration of a radio broadcast playback apparatus, according to an embodiment of the present invention.

Referring to FIG. 7, the radio broadcast playback apparatus 700 is provided. The radio playback apparatus 700 includes a tuner 710, a communication module 720, a control unit 730, an input unit 740, and a recording unit 750.

According to an embodiment of the present invention, the tuner 710 plays the radio broadcast. If a channel search request is received through the input unit 740, the communication module 720 searches for radio broadcasts while the tuner 710 receives the radio broadcast which is played currently. If the channel search has been completed, the tuner 710 presents the found radio channel corresponding to the radio broadcast being played.

The communication module 720 searches for the radio channel using XML Service Interface (XSI) information of the broadcast station. For example, the communication module 720 acquires frequency information using the XSI information received from the broadcast station and checks the frequency of the radio broadcast based on the frequency information.

According to an embodiment of the present invention, the tuner 710 receives the radio broadcast, which is played by the radio broadcast playback apparatus 700. The communication module 720 prepares for providing the radio broadcast on behalf of the tuner 710. If a channel scan request is received, the control unit 730 switches the playback path of the radio broadcast from the tuner 710 to the communication module 720. The tuner 710 scans radio channels while the radio broadcast playback apparatus 700 plays the radio broadcast received by the communication module 720. If the radio channel scanning has been completed, the radio broadcast playback apparatus 700 outputs the found radio channels. The control unit 730 switches the playback path of the radio broadcast from the communication module 720 to the tuner 710.

The communication module 720 extracts the frequency information from the XSI information of the broadcast station and searches for the radio broadcast which is identical with that received by the tuner 710 based on the extracted frequency information. For example, when the radio broadcast playback apparatus plays the radio broadcast received by the communication module instead of the tuner 710, the communication module 720 receives the radio broadcast on the channel having the lowest cost or bit rate among channels corresponding to the frequency information.

According to another embodiment of the present invention, the tuner 710 receives the radio broadcast being played while the recording unit 750 records the first radio broadcast. A user may request to record a second radio broadcast, which is different from the first radio broadcast. The input unit 740 receives the request for recording the second radio broadcast. The communication module 720 searches for the second radio broadcast for playback while the radio broadcast playback apparatus 700 plays the radio broadcast received by means of the tuner 710. The recording unit 750 then records the second radio broadcast.

The communication module 720 extracts the frequency information from the XSI information received from the broadcast station and searches for the second radio broadcast of the channel having the highest cost or bit rate based on the extracted frequency information.

According to an embodiment of the present invention, the tuner 710 is a FM module. That is, the tuner 710 is a module for receiving analog radio signals, and the communication module 720 is a module for receiving digital radio signals. The communication module 720 is responsible for voice, video, and data communications with another device, through a network, under the control of the control unit 730. The communication module 720 includes a radio frequency transmitter for up-converting and amplifying the transmission signal and a radio frequency receiver for low noise amplifying and down-converting the received signal. The communication module 720 also includes at least one of a mobile communication module (e.g. a $3^{rd}$ Generation (3G) mobile communication module, a 3.5G mobile communication module, a 4G mobile communication module, etc.), a Digital Broadcast Module (e.g. Digital Multimedia Broadcast (DMB) module), and a short range communication module (e.g. Wi-Fi module, Bluetooth module, and Near Field Communication (NFC) module).

According to an embodiment of the present invention, the input unit 740 includes a plurality of keys for receiving alphanumeric information and configuring various functions. These keys include a menu call key, a screen on/off key, a power on/off key, and a volume control key. The input unit 740 generates a key event related to the user configuration and function control of the radio broadcast playback apparatus 700 and sends the key event to the control unit 730. The key event includes a power on/off event, a volume adjustment event, a screen on/off event, and a shutter event. The control unit 730 controls the above components in response to the key events.

The radio broadcast playback apparatus 700 further includes a display unit in addition to the above-enumerated components. The display unit displays images under the control of the control unit 730. The display unit can be implemented with one of a Liquid Crystal Display (LCD), an Organic Light Emitting Diode (OLED) display, an Active Matrix OLED (AMOLED) display, and a flexible display.

The radio broadcast playback apparatus 700 is implemented with a touch panel integrating the input unit 740 and the display unit. The touch panel is placed on the display unit. In detail, the touch panel is implemented in one of add-on type which is located on the screen of the display unit, or an on-cell type, or an in-cell type which is inserted into the display unit.

Referring back to FIG. 1, the radio broadcast playback apparatus 700 plays the radio broadcast through the tuner 710 at step 110. The tuner 710 is a Frequency Modulation (FM) module for processing analog broadcast signal.

The control unit 730 of the radio broadcast playback apparatus 700 determines whether a channel scan request is detected at step 120. The channel scan request may be a channel switching request. The radio broadcast playback apparatus 700 receives the channel scan request of the user through input unit 740. The input unit 740 includes at least one of a keypad and a touchscreen to receive a user input.

In the conventional technology, if a channel switching or scan request is input, the ongoing radio broadcast playback is cut off. This is because the FM module which processes the radio broadcast cannot execute two commands at the same time. For example, since it takes about three minutes to scan the radio channels, the user may miss important information during the channel scanning due to the real-time nature of the radio broadcasting.

However, the radio broadcast playback apparatus 700, according to an embodiment of the present invention, is capable of controlling the communication module 720 to scan radio channels while playing the radio broadcast signal received by means of the tuner 710, in response to the channel scan request. The communication module 720 may be any of Wi-Fi, Bluetooth, and other short range communication modules. The communication module 720 receives digital broadcast signals independently of the tuner 710.

The communication module 720 receives XSI information from a broadcast station in step 130 while the radio broadcast playback apparatus 700 simultaneously plays the radio broadcast signal received through the tuner 710 at step 110*a*. The broadcast station may be a Domain Name Server (DNS) server. The communication module 720 extracts frequency information from the XSI information at step 140. The communication module 720 scans radio channels based on the extracted frequency information at step 150. That is, the communication module 720 checks the frequencies of radio broadcasts based on the extracted frequency information to scan the corresponding radio channels.

The control unit of the radio broadcast playback apparatus 700 determines whether the communication module 720 has completed the radio channel scan at step 160.

If the radio channel scan has been completed, the control unit of the radio broadcast playback apparatus 700 presents the scanned radio channels to the user at step 170. In this way, the radio broadcast playback apparatus 700 provides the user with the radio channel scan result without cutoff of ongoing radio broadcast playback.

Figure 2:
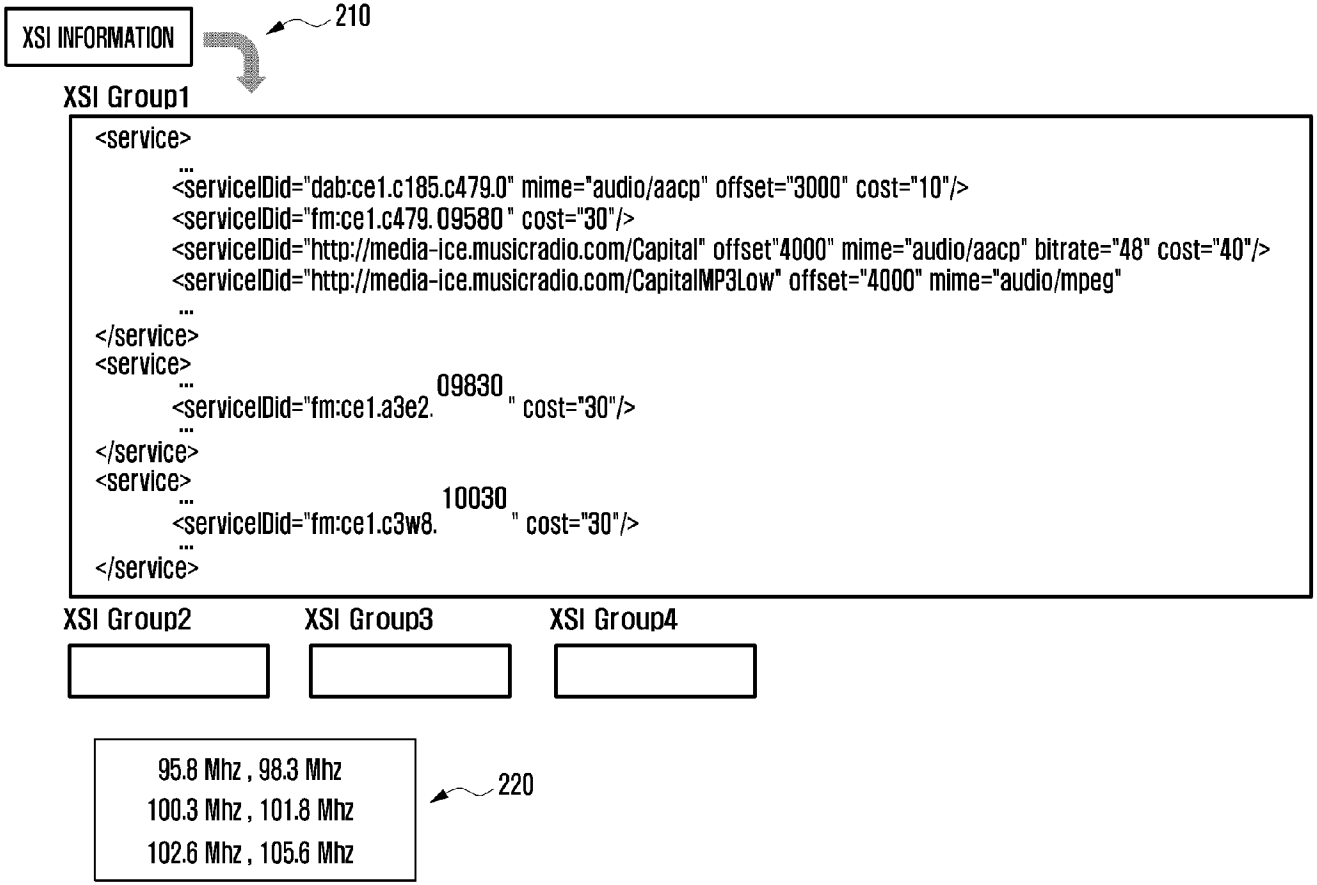
FIG. 2 is a diagram illustrating an example of scanning for a radio channel, according to an embodiment of the present invention.

FIG. 2 is a diagram illustrating an example of scanning for a radio channel, according to an embodiment of the present invention.

Referring to FIG. 2, the communication module 720 receives the XSI information from the broadcast station. The XSI information includes the broadcast station-specific program information. Accordingly, the communication module 720 performs the channel scanning by combining all XIS information received from multiple broadcast stations, in the same manner as the analog channel scanning. That is, the communication module 720 is capable of scanning the radio channels based on the XSI information as if the tuner scans the radio channels. The communication module 720 extracts frequency information from the XSI information as denoted by reference number 210. The communication module 720 is capable of scanning the radio channels by checking the radio broadcast frequencies using the extracted frequency information as denoted by reference number 220.

Since the communication module 720 is responsible for the time-consuming channel scanning operation, the tuner 710 can continue receiving the radio broadcast. Since the communication module 720, as an Internet radio (digital radio) tuner, performs the channel scanning instead of the analog radio tuner, it is possible to solve the problems occurring in analog radio scanning. Typically, the analog radio scanning has a drawback in that unnecessary channels and garbage channels are scanned so as to increase the channel scanning time. The radio broadcast playback method of the present invention performs the radio channel scanning based on the broadcast station-based XSI information by means of the communication module 720 as an Internet radio tuner so as to scan only the real existing channels. This means that no unnecessary and garbage channels are scanned, resulting in an improvement to radio channel scanning reliability.

Figure 3:
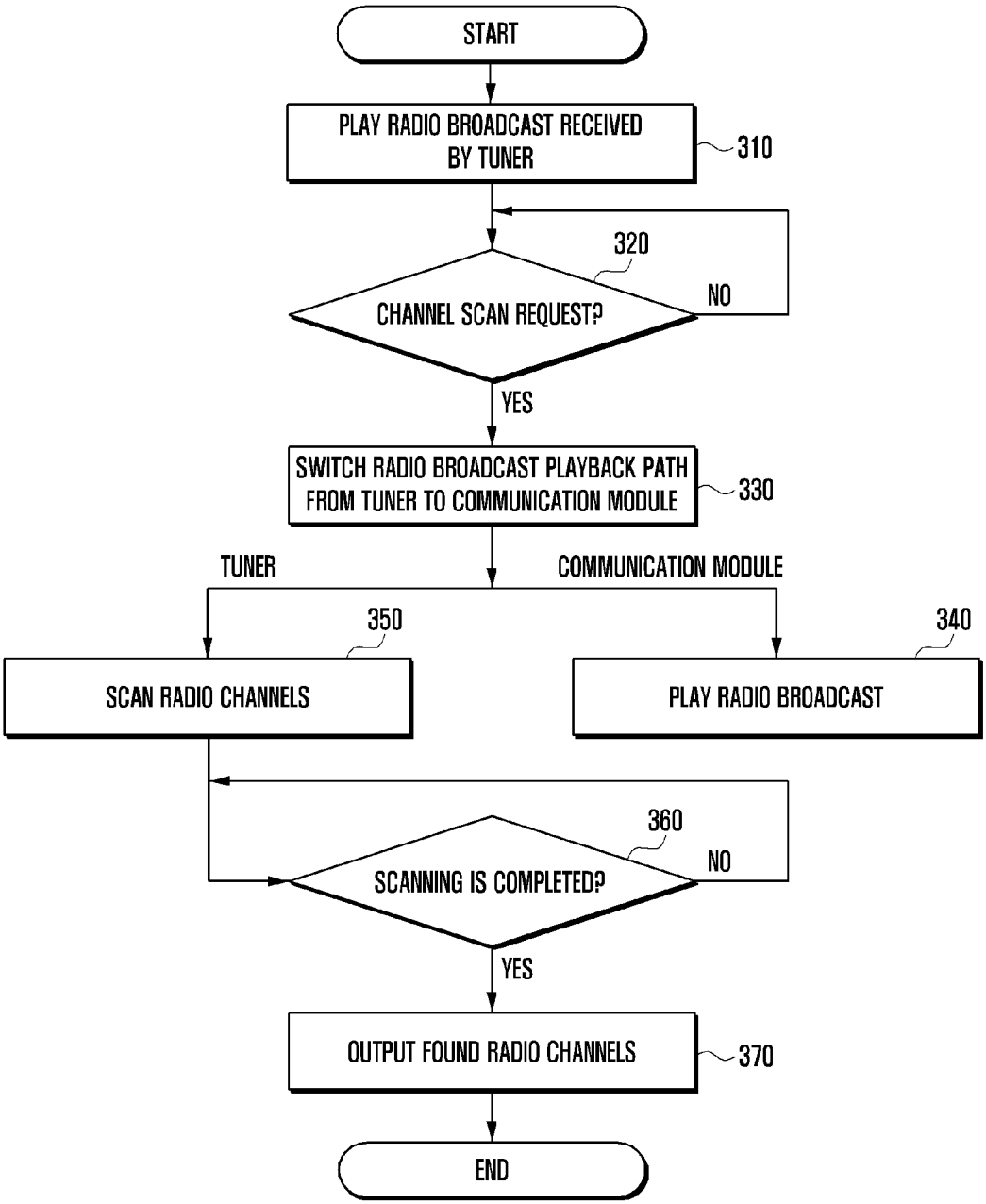
FIG. 3 is a flowchart illustrating a radio broadcast playback method, according to another embodiment of the present invention.

FIG. 3 is a flowchart illustrating a radio broadcast playback method, according to another embodiment of the present invention.

Referring to FIG. 3, the radio broadcast playback apparatus 700 plays the radio broadcast received by the tuner 710 at step 310. The tuner 710 is an FM module for processing analog broadcast signals.

The control unit 730 determines whether a channel scan request is received at step 320. The channel scan request is a channel switching request. The radio broadcast playback apparatus 700 receives the channel scan request of the user through the input unit 740.

The communication module 720 of the radio broadcast playback apparatus 700 prepares for playback of the radio broadcast after step 310 or 320. The communication module 720 receives the digital broadcast, unlike the tuner 710, which receives the analog broadcast. When the channel scan request is received, the communication module 720 prepares for playback of the radio broadcast in advance to continue playback the radio broadcast which is received by the tuner 710.

In order to minimize the time delay between the analog radio and digital radio, the radio broadcast playback apparatus 700 prepares the digital radio channel for starting the digital playback immediately upon switching from the analog radio to the digital radio. In this way, it is possible to continue playing the radio broadcast seamlessly when the broadcast receiver is changed from the tuner 710 to the communication module 720, while reducing the cost required in switching to the communication module 720 (time for connecting to the radio DNS server connection and time for acquiring internet broadcast information form the radio DNS server). The communication module 720 prepares for playing of the radio broadcast which the tuner 710 is receiving so as to switch from analog playback to digital playback quickly and smoothly, while conserving the switching costs.

In order to accomplish this, the communication module 720 receives the XSI information from the broadcast station, extracts the frequency information from the XSI information, and searches for the radio broadcast which is played by means of the tuner 710, based on the extracted frequency information.

The control unit 730 of the radio broadcast playback apparatus 700 switches the playback path of the radio broadcast from the tuner 710 to the communication at step 330.

The radio broadcast playback apparatus 700 plays the radio broadcast received by the communication module 720 at step 340. That is, the control unit 730 switches the playback path of the radio broadcast from the tuner 710 to the communication module 720 so as to continue playback of the radio broadcast seamlessly. Simultaneously, the tuner 710 scans radio channels at step 350.

The control unit 730 determines whether the radio channel scan has completed at step 360.

If the radio channel scan has completed, the control unit 730 controls to present the radio channels scanned by the tuner 710 at step 370. At this time, the control unit switches the playback path of the radio broadcast from the communication module 720 to the tuner 710.

Figure 4:
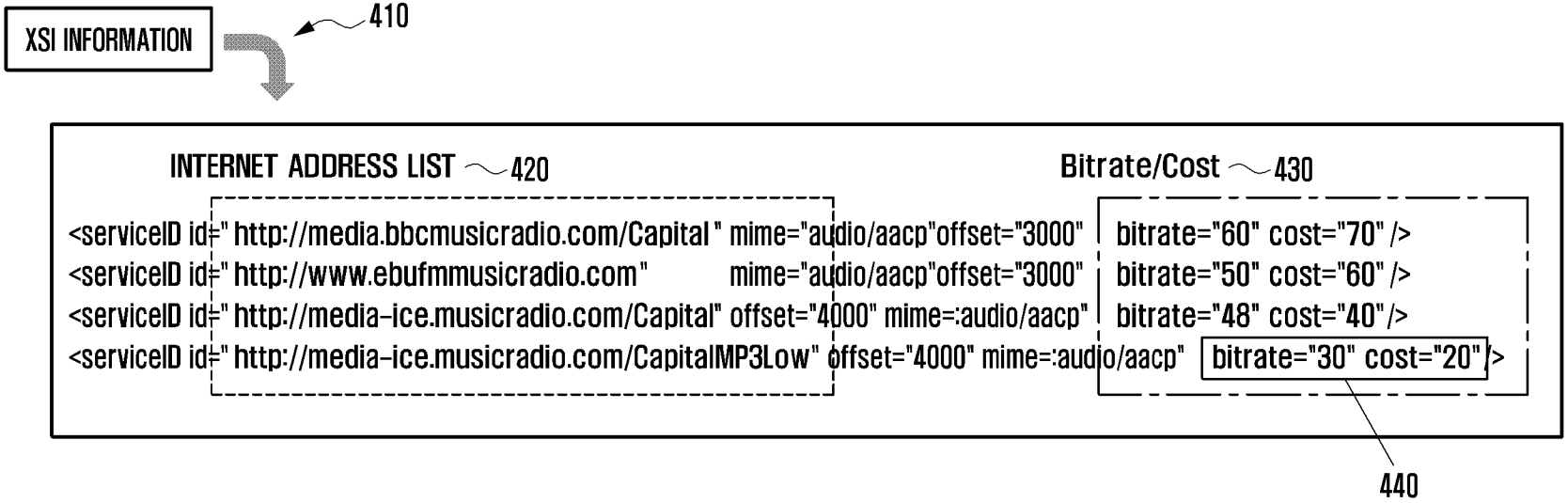
FIG. 4 is a diagram illustrating an example of preparing a radio broadcast playback apparatus for playback of a radio broadcast, according to an embodiment of the present invention.

FIG. 4 is a diagram illustrating an example of preparing a radio broadcast playback apparatus for playback of a radio broadcast, according to an embodiment of the present invention.

Referring to FIG. 4, the communication module 720 acquires Internet address information 420, i.e. service ID list, using the XSI information 410 of the broadcast station. The communication module 720 searches for the radio broadcast which is received by the tuner 710 using the Internet address information 420 so as to play the radio broadcast without cutoff while the tuner 710 scans radio channels.

The radio broadcast playback apparatus 700 takes the cost or bit rate into consideration, as denoted by reference number 430, in playing the radio broadcast received by the communication module 720. That is, in order to play the radio broadcast without latency, the communication module 720 plays the radio broadcast corresponding to the address 440 having the lowest cost or bit rate. This is to play the radio broadcast received by the communication module 720 as far as possible while the tuner 710 scans radio channels.

In conventional radio technology, using a single tuner, it is impossible to record two different radio broadcasting channels simultaneously. A single chip radio tuner cannot acquire the audio data of two different radio broadcast channels on air. Thus, it is presently not possible to record two separate broadcast channels simultaneously.

The radio broadcast playback method and apparatus of the present invention, however, is capable of recording two radio broadcasts, i.e. one radio broadcast by means of the tuner 710 and another radio broadcast by means of the communication module 720, simultaneously.

Figure 5:
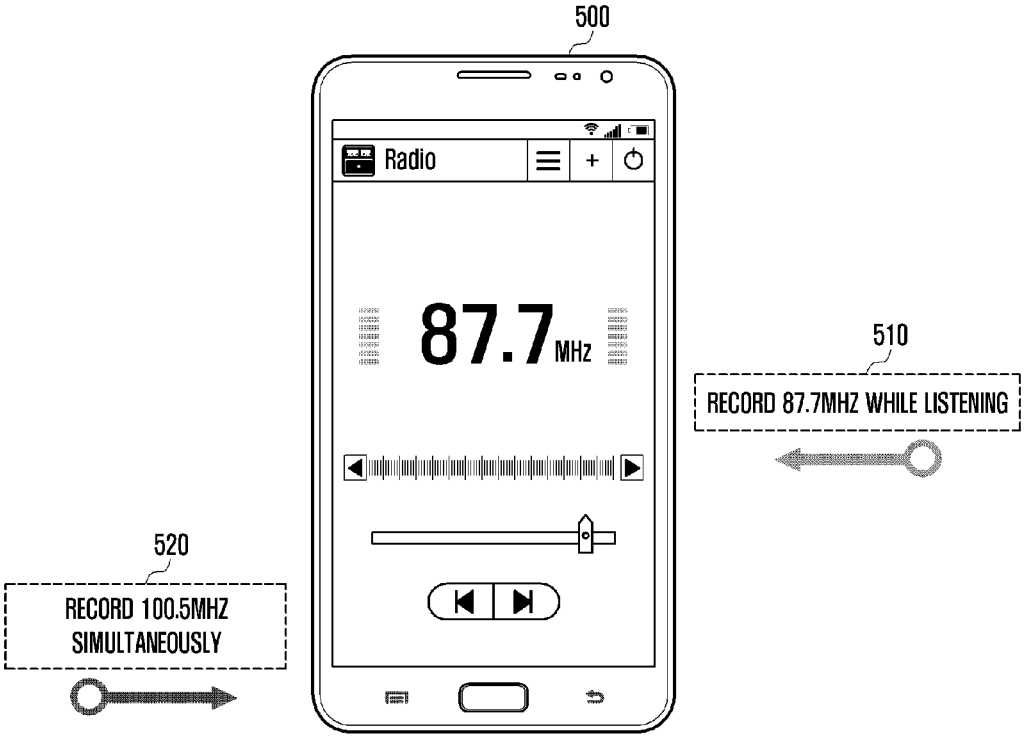
FIG. 5 is a diagram illustrating an example of recording a radio broadcast, according to another embodiment of the present invention.

FIG. 5 is a diagram illustrating an example of recording a radio broadcast, according to another embodiment of the present invention.

Referring to FIG. 5, the radio broadcast playback apparatus 500 plays and records the first radio channel of 87.7 MHz, as shown by reference numeral 510, by means of the tuner 710 and plays and records the second radio channel of 100.5 Mhz, as shown by reference numeral 520, simultaneously. At this time, the communication module 720 selects the radio broadcast channel having the highest cost or bit rate based on the XSI information. Typically, the user records the radio channel to replay the radio broadcast later and thus the quality of the recording result is important. Accordingly, the radio broadcast playback apparatus 500 prefers to receive the audio data of the radio broadcast channel having the highest cost or bit rate which corresponds to one of the Internet addresses.

Figure 6:
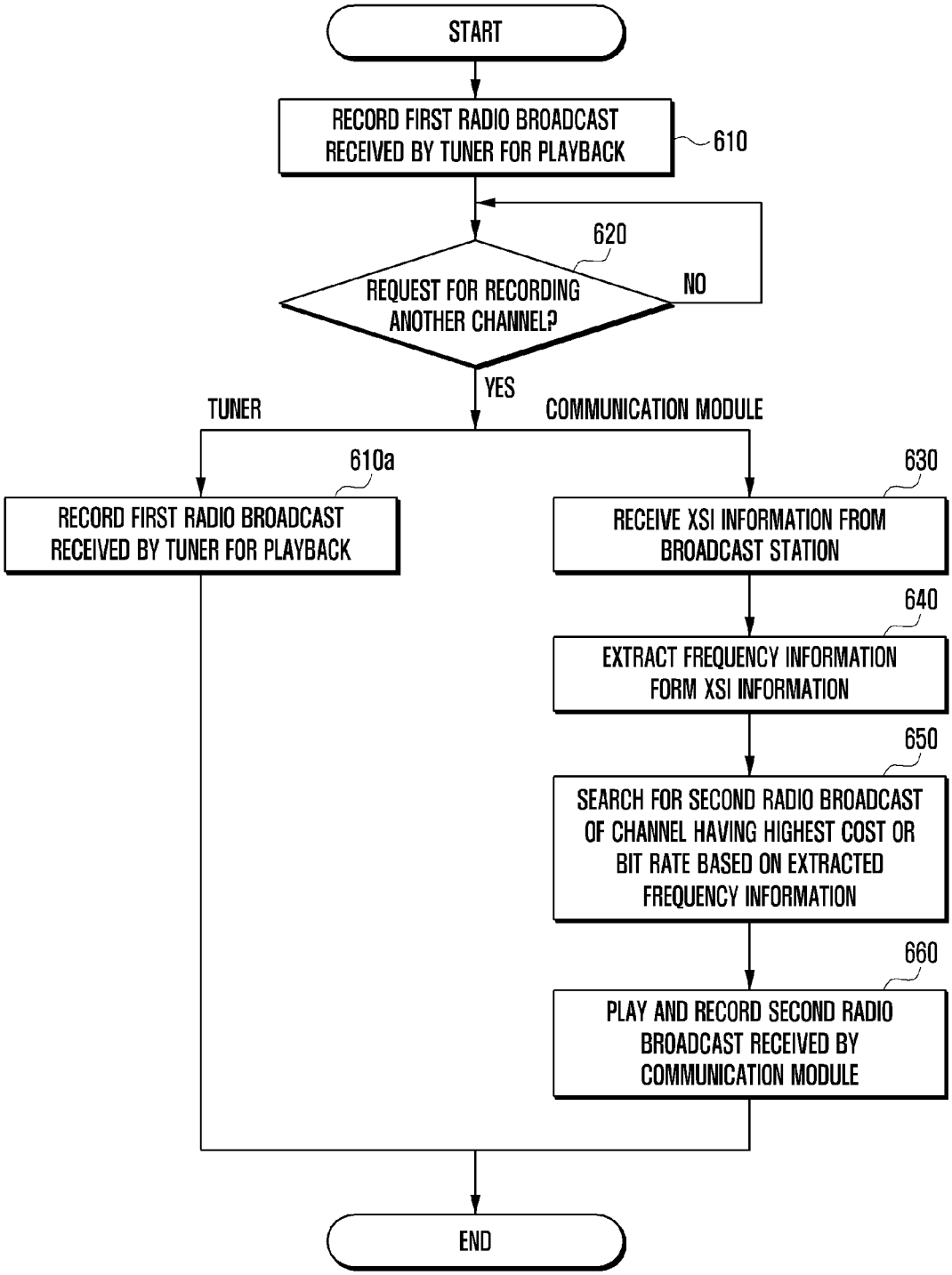
FIG. 6 is a flowchart illustrating a radio broadcast playback method, according to another embodiment of the present invention.

FIG. 6 is a flowchart illustrating a radio broadcast playback method, according to another embodiment of the present invention.

Referring to FIG. 6, a recording unit 750 of the radio broadcast playback apparatus 500 records the first radio broadcast which is received by the tuner 710 for playback at step 610.

The radio broadcast playback apparatus 500 monitors to detect a channel recording request for another channel at step 620. If a channel recording request is detected, the radio broadcast playback apparatus 500 determines whether the second radio broadcast indicated by the channel recoding request is identical to the first radio broadcast. For example, the first radio broadcast is of 87.7 Mhz, and the second radio broadcast is of 107.7 Mhz. If a channel recording request is received, the radio broadcast playback apparatus 500 searches for the second radio broadcast by means of the communication module 720 while playing the first radio broadcast received by means of the tuner 710.

The radio broadcast playback apparatus 500 receives the XSI information from the broadcast station by means of the communication module 720 at step 630, while it simultaneously records the first radio broadcast received by means of the tuner 710 at step 610*a*. The channel broadcast playback apparatus 500 acquires the frequency information by means of the communication module 720 using the XSI information at step 640. The radio broadcast playback apparatus 500 searches for the second radio broadcast, by means of the communication module 720, on the channel having the highest cost or bit rate based on acquired the frequency information at step 650.

The radio broadcast playback apparatus 500 plays the second radio broadcast found by means of the communication module 720 and records the second radio broadcast by means of the recording unit at step 660.

As described above, the radio broadcast playback method and apparatus of the present invention is advantageous in terms of allowing radio broadcast channels to be scanned while playing a radio broadcast channel.

Also, the radio broadcast playback method and apparatus of the present invention is advantageous in terms of continuing the ongoing radio broadcast playback seamlessly so as to improve user convenience.

Although the embodiments of the invention have been described using specific terms, the specification and drawings are to be regarded in an illustrative, rather than a restrictive, sense in order to help understand the present invention. Thus the scope of the invention should be determined by the appended claims and their legal equivalents rather than the specification, and those skilled in the art will appreciate that various alterations and modifications can be made therein without departing from the spirit and scope of the invention.

What is claimed is:

1. A method for simultaneous playback and radio channel scanning comprising:

playing a radio broadcast received by a tuner;

acquiring, while the radio broadcast is playing via the tuner, frequency information of the radio broadcast, using digital radio broadcast information received from a digital broadcast station by a communication module;

receiving a channel search request, through an input unit;

searching for radio channels, using a frequency corresponding to the radio broadcast, by the communication module, while playing the radio broadcast received by the tuner; and outputting found radio channels, wherein acquiring the frequency information comprises:

extracting the frequency information from XML Service Interface (XSI) information acquired from the digital broadcast station; and checking the frequency related to digital radio broadcast using the extracted frequency information.

2. The method of claim 1, wherein searching for the radio channels comprises searching the radio channels using the XSI information of the digital broadcast station, which is received by the communication module.

3. The method of claim 2, further comprising:

performing, by the communication module, a connection with the digital broadcast station;

receiving, by the communication module, the XSI information of the digital broadcast station, from the digital broadcast station; and checking a frequency of the radio broadcast using the acquired frequency information.

4. The method of claim 1, further comprising:

recording the received radio broadcast; and playing and recording the found radio broadcast by the communication module.

5. The method of claim 1, wherein searching for the radio channels comprises:

searching for the radio broadcast on a channel having highest cost or bit rate, based on the frequency information acquired by the communication module.

6. A method for simultaneous playback and radio channel scanning comprising:

playing a radio broadcast received by a tuner;

acquiring, while the radio broadcast is playing via the tuner, frequency information of the radio broadcast, using digital radio broadcast information received from a digital broadcast station by a communication module;

receiving a channel scan request, through an input unit;

switching a playback path of the radio broadcast from the tuner to the communication module;

playing the radio broadcast received by the communication module;

scanning radio channels, by means of the tuner; and displaying the radio channels found by the tuner, wherein acquiring the frequency information comprises:

extracting the frequency information from XML Service Interface (XSI) information acquired from the digital broadcast station; and checking a frequency related to digital radio broadcast using the extracted frequency information.

7. The method of claim 6, further comprising preparing for playing the radio broadcast received by the communication module.

8. The method of claim 7, wherein preparing for playing the radio broadcast comprises:

searching for the radio broadcast, which is received by the tuner, based on the frequency information acquired by the communication module.

9. The method of claim 6, wherein switching the playback path comprises playing the radio broadcast on a channel having lowest cost or bit rate, among channels corresponding to the frequency information acquired by the communication module.

10. A method for switching a playback path of a radio broadcast, the method comprising:

playing the radio broadcast received by a tuner;

acquiring, while the radio broadcast is playing via the tuner, frequency information of the radio broadcast, using digital radio broadcast information received from a digital broadcast station by a communication module;

receiving a request for digital radio playback, through an input unit; and switching the playback path from the tuner to the communication module;

wherein acquiring the frequency information comprises:

extracting the frequency information from XML Service Interface (XSI) information acquired from the digital broadcast station; and checking a frequency related to digital radio broadcast using the extracted frequency information.

11. The method of claim 10, wherein switching the playback path comprises playing the radio broadcast on a channel having lowest cost or bit rate, among channels corresponding to the frequency information acquired by the communication module.

12. A radio broadcast playback apparatus comprising:

a tuner configured to receive a radio broadcast for playback;

an input unit configured to receive a channel search request;

a communication module configured to acquire, while the radio broadcast is playing via the tuner, frequency information of the radio broadcast, using digital radio broadcast information received from a digital broadcast station, by a communication module, and search for radio channels using the acquired frequency information, while the radio broadcast received by the tuner is played; and a control unit configured to extract the frequency information from XML Service Interface (XSI) information acquired from the digital broadcast station, and check a frequency related to digital radio broadcast using the extracted frequency information, and control, when searching is completed, the tuner to output the found radio channels.

13. The apparatus of claim 12, wherein the communication module is further configured to search for the radio channels using the XSI information of the digital broadcast station.

14. The apparatus of claim 12, further comprising:

a recording unit configured to record radio broadcasts received by the turner and the communication module.

15. The apparatus of claim 14, wherein the input unit is further configured to receive a request for recording; and the communication module is further configured to extract the frequency information from the XSI information of the digital broadcast station while a first radio broadcast received by the tuner is played, search for a second radio broadcast of a channel having highest cost or bit rate, based on the acquired frequency information, and receive the second radio broadcast for playback while the first radio broadcast received by the tuner is played.

16. The apparatus of claim 14, wherein the tuner is a Frequency Modulation (FM) module.

17. A radio broadcast playback apparatus comprising:

a tuner configured to receive a radio broadcast for playback;

an input unit configured to receive a channel scan request; and a communication module configured to acquire, while the radio broadcast is playing via the tuner, frequency information of the radio broadcast, using digital radio broadcast information received from a digital broadcast station, and search for radio channels using the acquired frequency information, while the radio broadcast received by the tuner is played;

a control unit configured to extract the frequency information from XML Service Interface (XSI) information acquired from the digital broadcast station, and check a frequency related to digital radio broadcast using the extracted frequency information, switch a playback path of the radio broadcast from the tuner to the communication module, and control the communication module to receive the radio broadcast for playback, wherein the tuner scans radio channels in response to the channel scan request, and the control unit controls, when scanning is completed, the tuner to output the found radio channels.

18. The apparatus of claim 17, wherein the communication module is further configured to search for the radio broadcast received by the tuner, using the extracted frequency information.

19. The apparatus of claim 18, wherein the communication module is further configured to receive the radio broadcast of a channel having lowest cost or bit rate, among channels corresponding to the frequency information.

* * * * *